US007174737B2

(12) United States Patent
Frank et al.

(10) Patent No.: US 7,174,737 B2
(45) Date of Patent: Feb. 13, 2007

(54) REFRIGERATION PLANT FOR PARTS OF INSTALLATION, WHICH ARE TO BE CHILLED

(75) Inventors: Michael Frank, Uttenreuth (DE); Peter van Hasselt, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 232 days.

(21) Appl. No.: 10/507,848

(22) PCT Filed: Feb. 26, 2003

(86) PCT No.: PCT/DE03/00619

§ 371 (c)(1),
(2), (4) Date: Sep. 15, 2004

(87) PCT Pub. No.: WO03/078906

PCT Pub. Date: Sep. 25, 2003

(65) Prior Publication Data

US 2005/0150242 A1 Jul. 14, 2005

(30) Foreign Application Priority Data

Mar. 15, 2002 (DE) ..... 102 11 568

(51) Int. Cl.
*F25D 23/12* (2006.01)

(52) U.S. Cl. ..... 62/259.2; 165/104.33; 381/831

(58) Field of Classification Search ..... 62/6, 62/51.1, 259.2, 283; 165/104.21, 104.33; 361/700, 702, 831; 310/52
See application file for complete search history.

(56) References Cited

U.S. PATENT DOCUMENTS

| | | | | |
|---|---|---|---|---|
| 4,694,323 | A * | 9/1987 | Itahana et al. | 257/715 |
| 4,862,321 | A | 8/1989 | Saitoo et al. | |
| 5,333,460 | A * | 8/1994 | Lewis et al. | 62/6 |
| 5,396,206 | A | 3/1995 | Herd et al. | |
| 5,482,919 | A | 1/1996 | Joshi | |
| 5,953,930 | A * | 9/1999 | Chu et al. | 62/259.2 |
| 5,966,944 | A * | 10/1999 | Inoue et al. | 62/51.1 |
| 5,970,720 | A | 10/1999 | Katagiri et al. | |
| 6,107,905 | A | 8/2000 | Itoh et al. | |

(Continued)

FOREIGN PATENT DOCUMENTS

DE 199 14 778 10/1999

(Continued)

OTHER PUBLICATIONS

M. Bojic et al., "Controlling Evaporative Three Finger Thermosyphon", Energy Conversion & Management, vol. 43, 2002, pp. 709-720.

(Continued)

*Primary Examiner*—Mohammad M. Ali
(74) *Attorney, Agent, or Firm*—Staas & Halsey LLP

(57) ABSTRACT

A refrigeration plant includes at least two cold heads thermally coupled to parts of a particularly superconducting installation. The parts are to be chilled via a conduit system in which a cooling agent circulates according to a thermosyphon effect. The cold heads are connected in parallel by a forking of the conduit system. Sections of the conduit system, which are positioned between the forking and the cold heads, are configured at least in part so as to be low heat conductive.

12 Claims, 2 Drawing Sheets

U.S. PATENT DOCUMENTS

| | | | | |
|---|---|---|---|---|
| 6,122,920 | A * | 9/2000 | Hill et al. | 62/55.5 |
| 6,173,577 | B1 * | 1/2001 | Gold | 62/51.1 |
| 6,173,761 | B1 | 1/2001 | Chandratilleke et al. | |
| 6,246,308 | B1 | 6/2001 | Laskaris et al. | |
| 6,354,087 | B1 | 3/2002 | Nakahara et al. | |
| 6,367,266 | B1 * | 4/2002 | Kobayashi et al. | 62/51.1 |
| 6,376,943 | B1 * | 4/2002 | Gamble et al. | 310/52 |
| 6,388,882 | B1 * | 5/2002 | Hoover et al. | 361/704 |
| 6,536,510 | B2 * | 3/2003 | Khrustalev et al. | 165/104.33 |
| 6,553,773 | B2 * | 4/2003 | Laskaris | 62/64 |
| 6,571,110 | B1 * | 5/2003 | Patton et al. | 455/561 |
| 6,761,212 | B2 * | 7/2004 | DiPaolo | 165/122 |

FOREIGN PATENT DOCUMENTS

| | | | |
|---|---|---|---|
| DE | 100 39 964 | | 3/2002 |
| EP | 0 696 380 | | 7/1999 |
| JP | 4-159467 A | * | 6/1992 |
| JP | 10-89247 A | * | 4/1998 |
| WO | 00/13296 | | 3/2000 |

OTHER PUBLICATIONS

English Abstract of Japanese Patent Publication 2000-146333, published May 26, 2000.

K. Jikihara et al., "A Cryocooler Cooled 10.7T Superconducting Magnet with a Room Temperature Bore of 52mm", Proceedings of the Sixteenth International Cryogenic Engineering Conference, Part I, May 20-24, 1996, pp. 1109-1113.

Y. Ohtani et al., "Development of a 11.5T Liquid Helium-Free Superconducting Magnet System", Proceedings of the Sixteenth International Cryogenic Materials Conference, Part I, May 20-24, 1996, pp. 1113-1116.

Kevin Timms et al. "A Cryofree Superconducting Magnet for Industrial Applications", Proceedings of the Sixteenth International Cryogenic Materials Conference, Part I, May 20-24, 1996, pp. 1117-1132.

Kazuo Watanabe et al., "Cryocooler-Cooled Large Bore NbTi Superconducting Magnet Using High Temperature Superconducting Current Leads", Proceedings of the Sixteenth International Cryogenic Materials Conference, Part I, May 20-24, 1996, pp. 1121-1124.

Hisashi Isogami et al., "A Superconducting Magnetic Separator with an Integral Refrigerator for Blue-Green Algae", Proceedings of the Sixteenth International Cryogenic Materials Conference, Part I, May 20-24, 1996, pp. 1125-1128.

Kazuyuki Shibutani et al., "Design and Fabrication of Cryogen Free Superconducting Magnet", Proceedings of the Sixteenth International Cryogenic Materials Conference, Part I, May 20-24, 1996, pp. 1129-1132.

* cited by examiner

REFRIGERATION PLANT FOR PARTS OF INSTALLATION, WHICH ARE TO BE CHILLED

CROSS REFERENCE TO RELATED APPLICATIONS

This application is based on and hereby claims priority to German Application No. 102 11 568.0 filed on 15 Mar. 2002, the contents of which are hereby incorporated by reference.

BACKGROUND OF THE INVENTION

1. Field of the Invention

The invention relates to a refrigeration plant having a cold head which is thermally coupled, via a system of lines for a refrigerant which circulates in accordance with a thermosyphon effect, to parts of an installation which are to be cooled. A corresponding refrigeration installation is also given by WO 00/13296 A.

2. Description of the Related Art

In addition to metallic superconductor materials, such as NbTi or $Nb_3Sn$, which have long been known and have very low critical temperatures $T_c$ and are therefore also referred to as low-$T_c$ superconductor materials or LTS materials, metal-oxide superconductor materials with critical temperatures $T_c$ of over 77 K have been known since 1987. The latter materials are also known as high-$T_c$ superconductor materials or HTS materials.

Attempts have also been made to create superconducting windings with conductors using HTS materials of this type. However, the conductors of such windings, on account of their hitherto still relatively low ability to carry current in magnetic fields in particular with inductions in the Tesla range, despite the inherently high critical temperatures of the materials used, are nevertheless frequently held at a temperature level below 77 K, for example between 10 and 50 K, in order in this way to make it possible to carry significant currents at field strengths of several Tesla.

Refrigeration units in the form of cryogenic coolers with a closed He compressed gas circuit are preferentially used to cool windings with HTS conductors within the abovementioned temperature range. Cryogenic coolers of this type are in particular in the form of Gifford-McMahon or Stirling type, or in the form of what are known as pulse tube coolers. Corresponding refrigeration units moreover have the advantage that the refrigeration capacity is available virtually at the push of a button, and there is no need for the user to handle cryogenic liquids. When refrigeration units of this type are used, a superconducting device, such as a magnet coil or a transformer winding, is cooled only indirectly by heat conduction to a cold head of a refrigerator (cf. for example also "Proc. 16th Int. Cryog. Engng. Conf. [ICEC 16]", Kitakyushu, J P, 20-24.05.1996, Verlag Elsevier Science, 1997, pages 1109 to 1129).

A corresponding cooling technique is also provided for the superconducting rotor of an electrical machine which is disclosed by the WO-A document cited in the introduction. The rotor includes a winding composed of HTS conductors, which can be kept at a desired operating temperature of well below 77 K by a refrigeration unit configured as a cryogenic cooler. The refrigeration unit includes a cold head located outside the rotor. The colder side of this cold head is thermally coupled to the winding using neon as refrigerant, which circulates in a system of lines, which includes parts that project into the rotor as far as the winding, using a thermosyphon effect. In the event of a fault in the refrigeration unit, in particular its cold head, or in the event of the latter having to be repaired or exchanged, however, it is almost impossible to maintain the operating state of the winding which is to be cooled.

Furthermore, EP 0 696 380 B1 discloses a superconducting magnet of an MRI installation which, to cool its superconducting winding, has a refrigeration plant which includes two refrigeration units in the form of cryogenic coolers. The two cold heads of these cryogenic coolers are thermally coupled to a solid heat conduction body which is thermally conductively connected to parts of the winding that are to be cooled. The cold heads of the two cryogenic coolers are each accommodated in a dedicated vacuum space, so that during operation of one cryogenic cooler the second can be switched off and/or exchanged. On account of the connection of a plurality of cold heads with good thermal conductivity to form the same parts that are to be cooled, however, additional thermal conduction losses caused by a cold head which may be switched off generally have to be accepted.

SUMMARY OF THE INVENTION

It is an object of the present invention to configure the refrigeration plant having the features described in the introduction in such a way that in the event of cooling using a refrigerant that circulates in line parts using a thermosyphon effect, allowing continuous cooling operation without there being any risk of significant thermal conduction losses via the circulating refrigerant.

According to the invention, this object is achieved by virtue of the fact that at least one further cold head is provided, connected in parallel with the first cold head by a branching point in the system of lines, line sections of the system of lines which run between the branching point and the two cold heads each at least in part being designed to have a poor thermal conductivity. In this context, a line section of poor thermal conductivity is to be understood as meaning that the introduction of heat into the region of the respective cold head caused by its tubular material is negligible compared to the refrigeration capacity made available by the head.

The refrigeration plant designed in accordance with the invention therefore includes a plurality of separate regions at which the recondensation of the refrigerant or of a working gas takes place in a thermosyphon system of lines. The associated advantages are in particular that thermal coupling of a correspondingly large number of cold heads is made possible in a simple way. The sufficiently poor thermal conduction in the line sections of the thermosyphon system of lines then allows economic operation with negligible additional introduction of heat even at part-load without all the cold heads installed having to operate simultaneously. This in particular allows a cold head to be replaced, for example for maintenance or repair reasons, while at the same time maintaining the operating temperature at those parts of the superconducting device which are to be cooled with the aid of the remaining cold head(s). Moreover, on account of the branching of line parts, it is possible for the branched line sections to be of sufficiently flexible configuration in order, for example, to allow temperature-induced changes in length, which inevitably arise in the case of cold heads at different temperature levels, in the region of bends, for example, to be mechanically compensated for.

For example, the line sections which are of poor thermal conductivity may preferably each at least in part be made of a metallic material of poor thermal conductivity or possibly even a plastics material. This makes it possible to achieve not only the desired thermal decoupling of the two cold heads from the parts that are to be cooled via the wall material of the line sections, but also to control any expansion problems.

Furthermore, the installation that is to be cooled may be located in the interior of a vacuum vessel, with end parts, to which the line sections are thermally coupled, of the cold heads projecting into the vacuum vessel. This makes it possible to limit the undesirable introduction of heat into the region of the installation that is to be cooled.

It is advantageously possible for the cold heads to have end-side cold surfaces, to which end spaces of the line sections, in which cooling or condensation of the refrigerant takes place, are thermally coupled. This allows a flow of refrigerant to fan out utilizing the desired thermosyphon effect.

In particular in order to facilitate maintenance or repair work, the end parts of the cold heads may be surrounded by separate (dedicated) vacuum (part)-spaces, which may, for example in the region of the ends of the cold heads or at the line sections, be suitable for isolation from the remaining interior of the vacuum vessel by vacuum-tight connection-pieces which are of poor thermal conductivity.

The plant according to the invention is particularly suitable for parts of the installation that are to be cooled which contain superconducting material, preferably high-$T_c$ superconductor material, which is also to be held at a temperature of less than 77 K.

With a view to effective cooling of the parts of the installation that are to be cooled, it is advantageously possible to provide for the refrigerant used to be a mixture of a plurality of refrigerant components with different condensation temperatures. As an alternative or in addition, it is also possible to incorporate a plurality of thermosyphon systems of lines with different refrigerants.

BRIEF DESCRIPTION OF THE DRAWINGS

These and other objects and advantages of the present invention will become more apparent and more readily appreciated from the following description of two preferred exemplary embodiments of refrigeration plants according to the invention for in particular a superconducting installation with reference to the drawings, of which.

DETAILED DESCRIPTION OF THE PREFERRED EMBODIMENT

Reference will now be made in detail to the preferred embodiments of the present invention, examples of which are illustrated in the accompanying drawings, wherein like reference symbols refer to like elements throughout.

The refrigeration plant according to the invention can be used wherever a plurality of refrigeration sources are provided for cooling even extensive parts of any desired installation. Their parts which are to be cooled may be metallic or nonmetallic, electrically conductive, in particular superconducting, or also nonconductive. In one specific application, the parts to be cooled are a superconducting winding of an electrical machine (cf. for example the abovementioned WO 00/13296 A or U.S. Pat. No. 5,482,919 A) or a superconducting magnet (cf. for example U.S. Pat. Nos. 5,396,206 A or US 6,246,308 B1).

Figure 1:
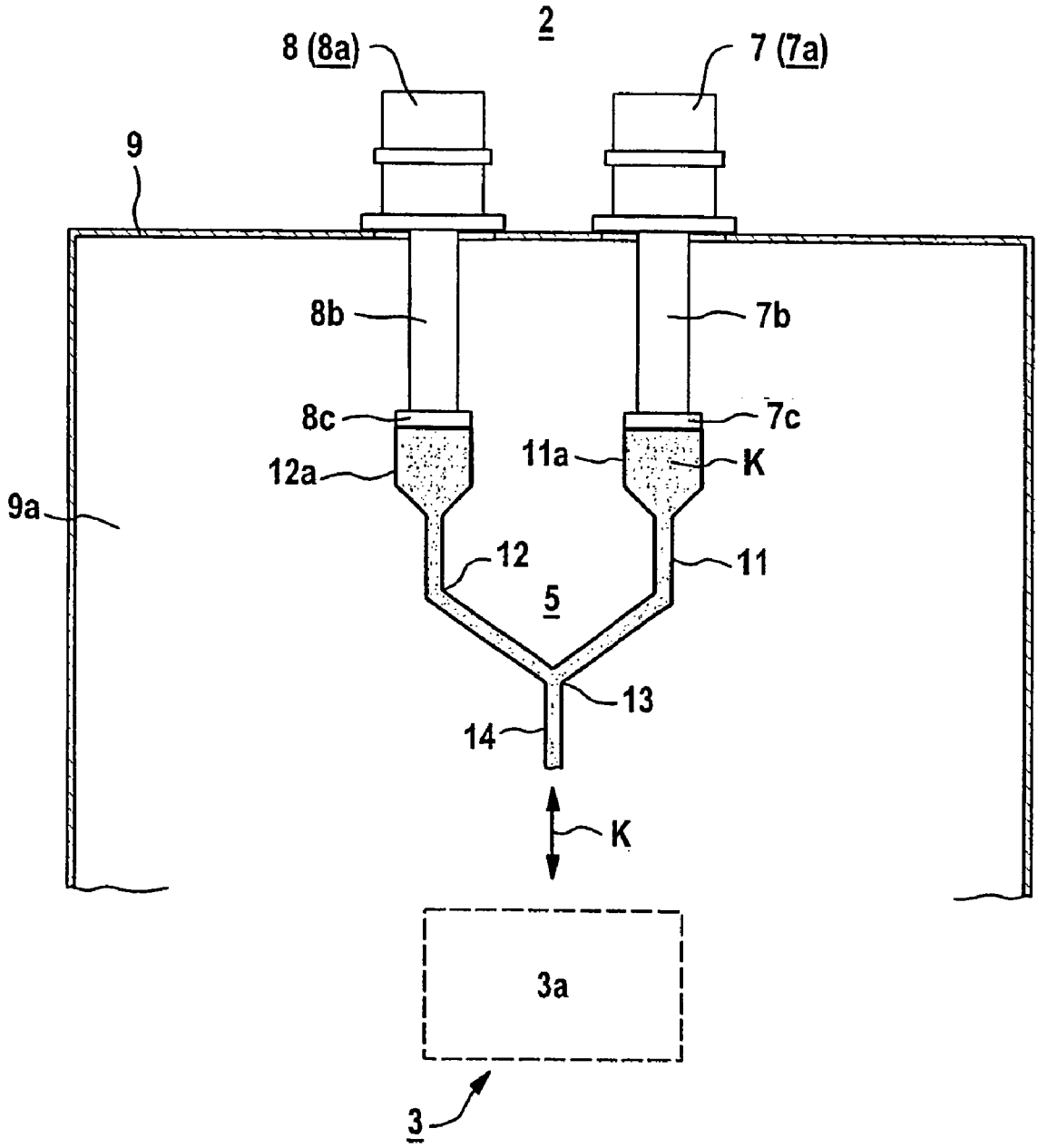
FIG. 1 is a schematic longitudinal section of a first embodiment of a refrigeration plant.

A further application may be for two cold heads to be operated simultaneously to save time during cooling of the parts of an installation that are to be cooled, whereas in normal operation just one cold head maintains the operating temperature. For a corresponding application, it is preferably possible to provide a refrigeration plant as indicated in FIG. 1. The refrigeration plant, which is denoted overall by 2, is to be used to cool parts 3*a* of an installation 3, which is not shown in more detail in FIG. 1, for example of a superconducting magnet. The cooling is carried out with the aid of a liquid and/or gaseous refrigerant K or working medium, such as for example He, which circulates in a system of lines 5 using a thermosyphon effect. Therefore, the system of lines 5 may also be referred to as a thermosyphon system of lines. The refrigeration capacity is provided by two refrigeration units 7*a* and 8*a*, of which in each case only the cold heads 7 and 8, respectively, are indicated in FIG. 1. These cold heads should be located substantially outside a vacuum vessel 9 which serves to thermally insulate the installation 3, including its parts 3*a* that are to be cooled, which is located in its interior 9*a*. In the case of the specific embodiment shown in FIG. 1, only end parts 7*a* and 8*b* which are of good thermal conductivity of the cold heads project into the interior 9*a* of the vessel, where they form cold surfaces 7*c* and 8*c*, respectively, at their lower ends, facing the installation 3. End spaces, which are to be regarded as condenser spaces 11*a* and 12*a*, of two line sections 11 and 12, respectively, of the system of lines 5 are directly thermally coupled to these cold surfaces. In the refrigeration plant 2 configured in accordance with the invention, therefore, there is a thermosyphon system of lines 5 having a plurality of separator condenser spacers 11*a*, 12*a*, in which the refrigerant K can recondense as part of a thermosyphon process. At a branching point 13 in the system of lines 5, the line sections 11 and 12 merge into a common line part 14 which leads into the region of the installation 3 that is to be cooled. The two cold heads 7 and 8 can therefore be described as being connected in parallel by the branching point 13 and the two line sections 11 and 12.

According to the invention, the line sections 11 and 12 should at least in part be designed to be of sufficiently poor thermal conductivity. This allows the two cold heads to be thermally decoupled from one another, so that an individual condenser space 11*a* or 12*a* can be warmed, for example to room temperature, without significant amounts of heat being supplied to the parts that are to be cooled and/or to the refrigerant K located in the interior of the system of lines. The line sections 11 and 12 can advantageously be configured in such a way that it is also possible to compensate for differential expansion. By way of example, the line sections 11 and 12 may each include materials of poor thermal conductivity, such as for example special steels or Cu alloys. If appropriate, it is also possible to employ particular plastics materials, optionally fiber-reinforced, that are suitable for low temperatures or ceramic materials. It is also possible to provide different materials and/or different configurations for these line sections. By way of example, the line sections may have bends, for example spiral formations, which make it possible to compensate for thermally induced changes in length.

Figure 2:
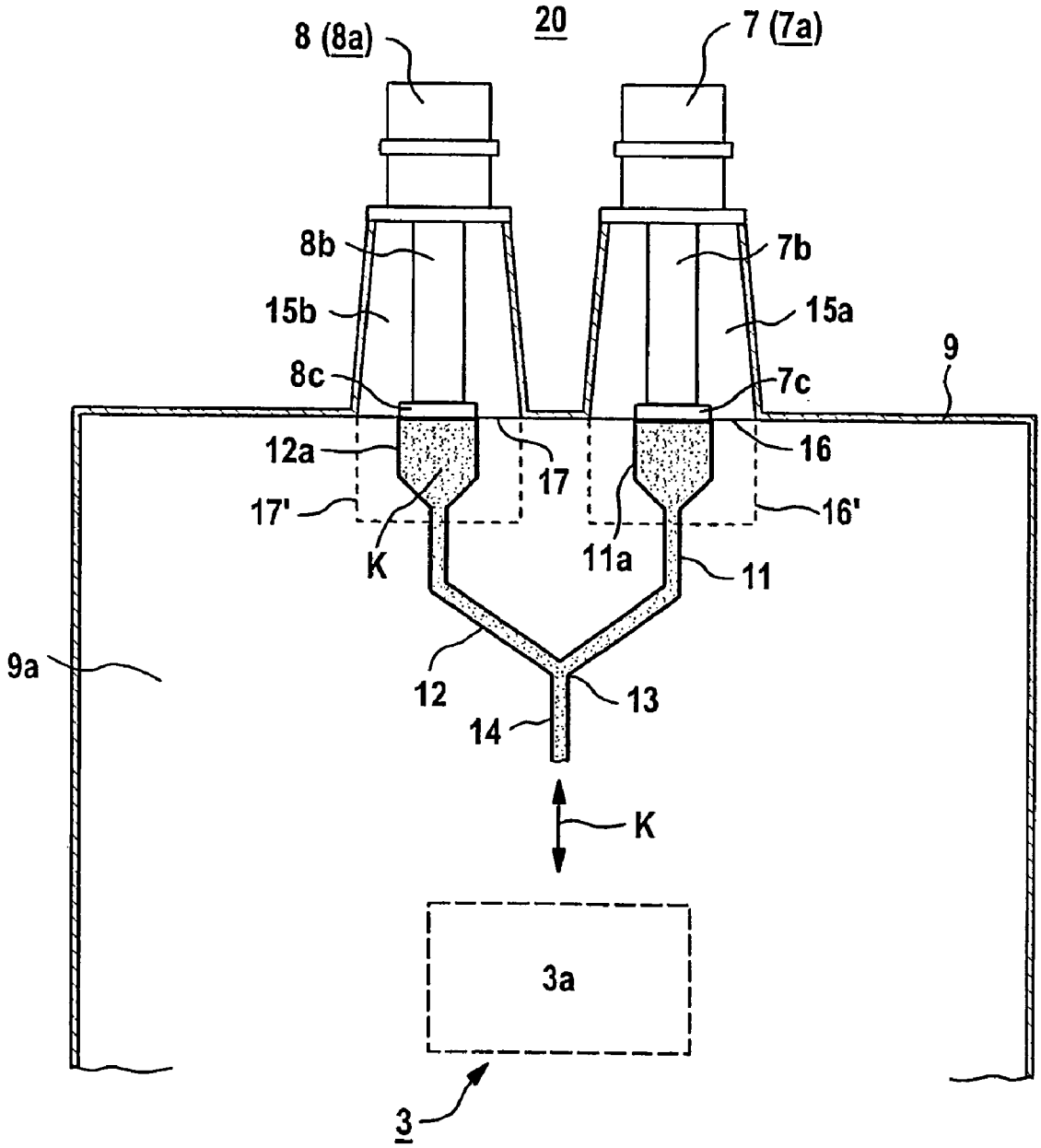
FIG. 2 is a schematic longitudinal section of a particular refinement of this installation.

In the event of one of the cold heads failing, the second cold head, following a cooling time, could take over (emergency) cooling while the first cold head can be warmed, replaced and/or repaired without the need to rush and without the cooling of the system being impaired. In such an event of maintenance work having to be carried out at a cold head without the cooling being impaired, the vacuum spaces which are generally required for the thermal insulation for the thermosyphon system of lines, on the one hand, and the cold heads, on the other hand, should be suitable for disconnection from one another. It is then possible for any cold head to be dismantled individually without the thermal insulation of the remaining thermosyphon system of lines being impaired. A corresponding exemplary embodiment is revealed in FIG. 2. In the refrigeration installation which is indicated and denoted by 20, the two end parts 7*b* and 8*b* of its cold heads 7 and 8, respectively, are advantageously each located in a separate vacuum part-space 15*a* and 15*b*, respectively. In the text which follows, these part-spaces are considered to form part of the vacuum vessel 9, although they may also be attached to this vessel. In any event, these vacuum part-spaces are separated from the remaining interior 9*a*, which accommodates the installation 3 which is to be cooled, of the vacuum vessel, for example by vacuum-tight connection pieces 16 and 17 in the region of the cold surfaces 7*c* and 8*c*, respectively. The required vacuum-tight connection between the thermosyphon system of lines 5 and the cold heads 7 and 8 is in this case advantageously designed to have as low a thermal conductivity as possible. In accordance with FIG. 2, this connection between the warm vacuum vessel 9 and the thermosyphon system of lines 5, which in operation is cold, is formed in the region of its condenser spacers 11*a* and 12*a*. If appropriate, to optimize the thermal losses occurring at this cold/warm connection, however, it is also possible for this connection to be provided directly at the system of pipes, including at other locations in the line sections 11 and 12 with a considerably smaller diameter. As is intended to be indicated in FIG. 2 by dashed lines denoted by 16' and 17', a corresponding separation can also be incorporated, for example, downstream of the end spaces 11*a* and 12*a* which are of widened cross section.

Of course, a refrigeration plant according to the invention can also be designed with a plurality of thermosyphon systems of lines, at least one of which must have two cold heads connected in parallel by a branching point in this system. A plurality of systems of this type can be used in parallel with different refrigerants and therefore, depending on the particular requirements of the application, correspondingly graduated working temperatures, for example for pre-cooling, quasi-continuous thermal cooling or quasi-continuous thermal coupling through overlapping working temperature ranges of the refrigerants. For this purpose, it is possible to fit either condenser spaces with separate condensation regions for the different working media or a plurality of individual condenser spacers to a cold head or the cold heads.

Furthermore, in the case of the exemplary embodiments of refrigeration plants 2 or 20 explained with reference to the figures, it has been assumed that the refrigerant K consists of just a single component, such as for example He or Ne. However, it is equally possible for the refrigerant used to be mixtures of at least two refrigerant components, such as for example $N_2$+Ne, with different condensation temperatures. Accordingly, it is then possible, with gradual cooling of at least one of the cold heads, for the gas with the highest condensation temperature to be condensed first and to form a closed circuit for the transfer of heat to those parts of the installation which are to be cooled. After pre-cooling of these parts down to the triple point temperature of this gas, the latter will freeze in the region of the condenser spacers, after which at least one cold head is cooled to the condensation temperature of the next component of the gas mixture. In this case, the individual components of the gas mixture can be selected in such a way that quasi-continuous cooling can advantageously be realized with optimum utilization of the refrigeration capacity of the respective cold head. This is because operation of a cold head at a higher temperature at the start of the cooling phase leads to a correspondingly greater refrigeration capacity and therefore allows significantly shorter cooling times to be achieved.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide* v. *DIRECTV,* 69 USPQ2d 1865 (Fed. Cir. 2004).

The invention claimed is:

1. A refrigeration plant, comprising:

an installation having parts to be cooled;

at least two cold heads;

a system of lines including line sections and at least one branching point to connect said at least two cold heads in parallel and carrying a refrigerant circulating in accordance with a thermosyphon effect to thermally couple said at least two cold heads to the parts of said installation, at least part of the line sections running between the at least one branching point and said at least two cold heads having poor thermal conductivity, and a vacuum vessel having an interior in which said installation is arranged, and wherein said cold heads include end parts, thermally coupled to the line sections, projecting into said vacuum vessel.

2. The refrigeration plant as claimed in claim 1, wherein the line sections of poor thermal conductivity each at least in part includes a plastic or metallic material of poor thermal conductivity.

3. The refrigeration plant as claimed in claim 2, wherein the line sections include end spaces in which at least one of cooling and condensation of the refrigerant takes place, and wherein said cold heads have end-side cold surfaces to which the end spaces of the line sections are thermally coupled.

4. The refrigeration plant as claimed in claim 3, wherein the end spaces have a widened cross section.

5. The refrigeration plant as claimed in claim 4, wherein said vacuum vessel includes vacuum-tight connection pieces of poor thermal conductivity, forming separate vacuum spaces surrounding and isolating at least the end parts of the cold heads from the interior of said vacuum vessel.

6. The refrigeration plant as claimed in claim 5, wherein the vacuum-tight connection pieces extend between the end-side cold surfaces of the end parts and said vacuum vessel.

7. The refrigeration plant as claimed in claim 5, wherein the connection pieces extend between said line sections and said vacuum vessel.

8. The refrigeration plant as claimed in claim 6, wherein the parts of said installation to be cooled contain superconducting material.

9. The refrigeration plant as claimed in claim 8, wherein the superconducting material is high-$T_c$ superconductor material.

10. The refrigeration plant as claimed in claim 9, wherein the superconducting material is to be held at a temperature below 77 K.

11. The refrigeration plant as claimed in claim 10, wherein the refrigerant provided is a mixture of refrigerant components having different condensation temperatures.

12. The refrigeration plant as claimed in claim 11, wherein said system of lines includes a plurality of thermosyphon line systems.

* * * * *